United States Patent [19]

Green

[11] 4,113,538

[45] Sep. 12, 1978

[54] METHOD OF AND MEANS FOR MOUNTING LABELS

[76] Inventor: Russell W. Green, P.O. Box 155, Wayne, Ill. 60184

[21] Appl. No.: 717,232

[22] Filed: Aug. 24, 1976

[51] Int. Cl.[2] ..... B32B 31/00

[52] U.S. Cl. ..... 156/247; 156/249; 156/349; 156/285; 156/584; 156/344; 156/DIG. 20; 269/21; 428/40; 156/DIG. 37

[58] Field of Search ..... 156/227, 349, 247, 443, 156/249, 497, 285, 579, 344, 584, 108, DIG. 20, 37, 538, 556, 539; 269/21; 428/40; 33/80; 312/231

[56] References Cited

U.S. PATENT DOCUMENTS

| | | | |
|---|---|---|---|
| 2,308,900 | 1/1943 | Tryon et al. | 428/40 |
| 2,547,487 | 4/1951 | Penney | 156/247 |
| 2,725,322 | 11/1955 | Muttera | 156/247 |
| 2,804,691 | 9/1957 | Justis | 33/80 |
| 3,328,022 | 6/1967 | Miller | 269/21 |
| 3,719,997 | 3/1973 | Hulen | 33/80 |

*Primary Examiner*—William A. Powell
*Assistant Examiner*—J. J. Gallagher
*Attorney, Agent, or Firm*—Eugene F. Friedman; Elmer L. Zwickel

[57] ABSTRACT

The invention relates to improvements in the method of and means for automatic attachment of labels or transparent envelopes having a pressure sensitive adhesive backing, on a sheet of material such as a file folder or the like.

5 Claims, 8 Drawing Figures

Fig. 1.
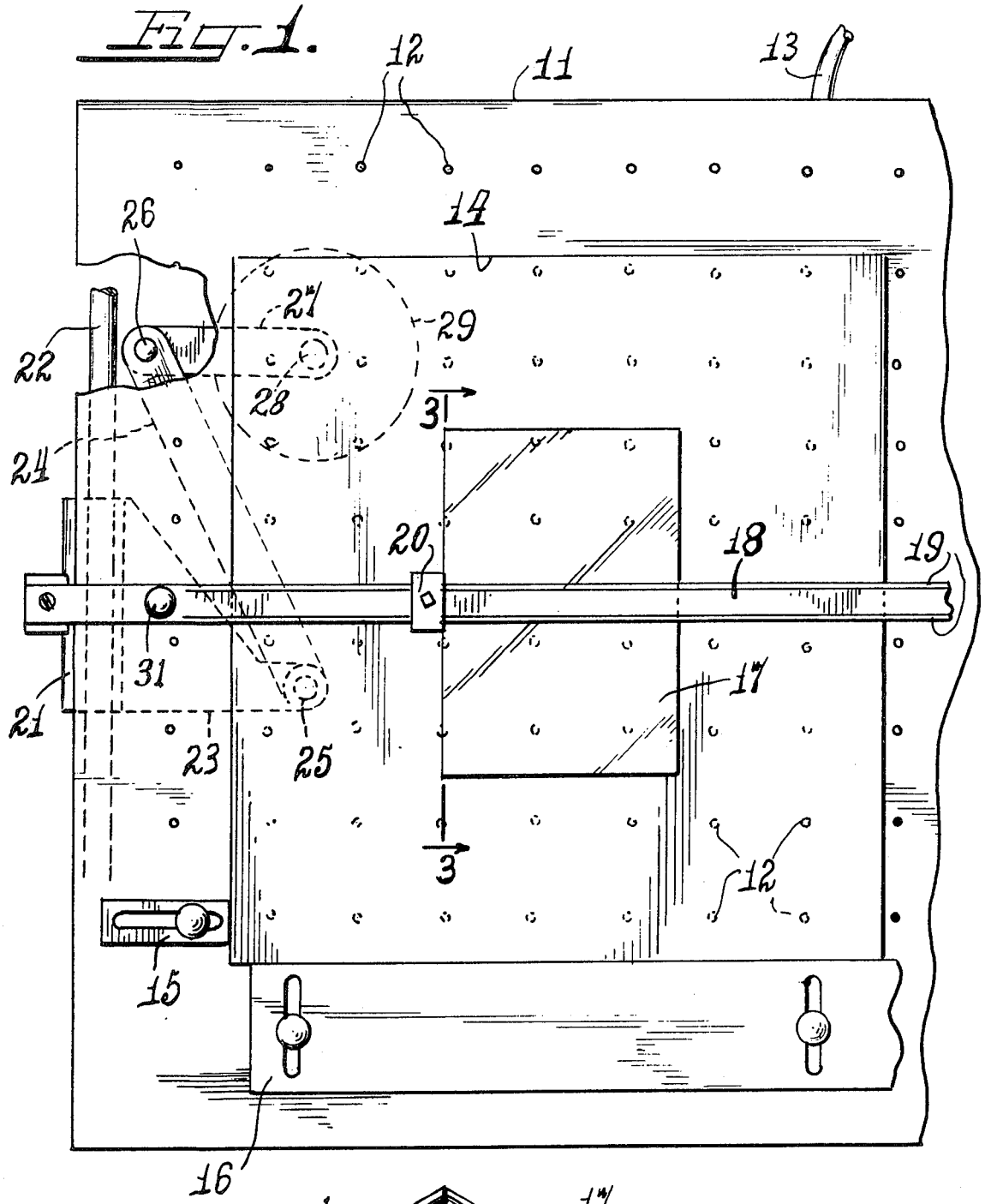
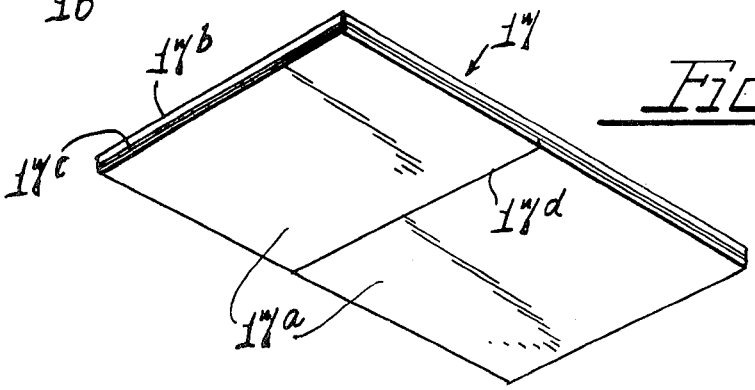
Fig. 2.

Fig. 3.
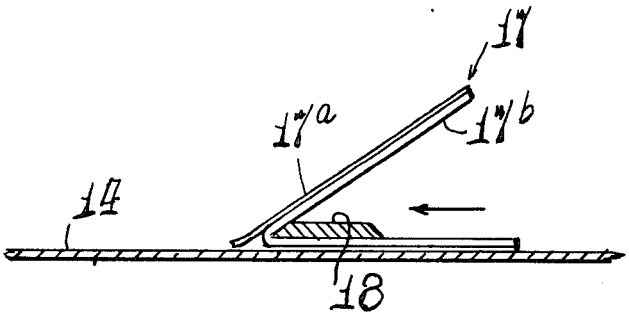
Fig. 4.
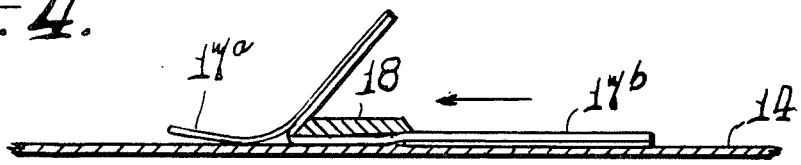
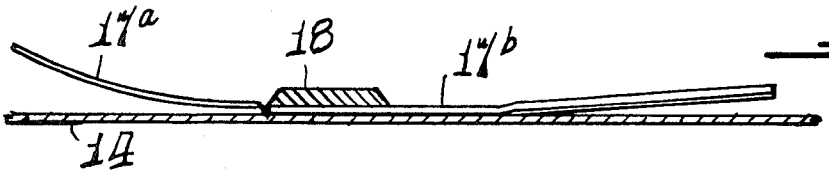
Fig. 5.
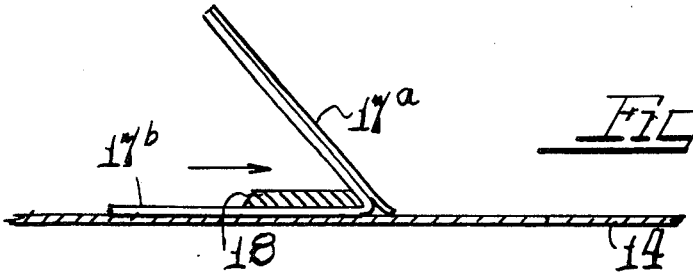
Fig. 6
Fig. 7
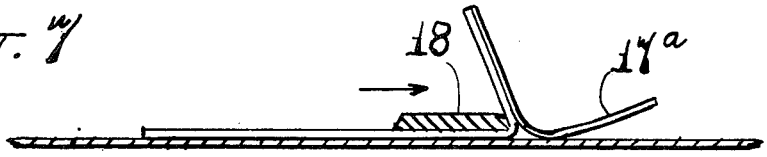
Fig. 8.
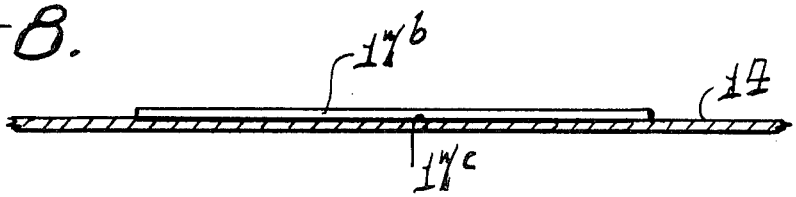

METHOD OF AND MEANS FOR MOUNTING LABELS

BACKGROUND OF THE INVENTION

A commonly accepted practice is to manually affix adhesive bearing labels or transparent envelopes (hereinafter referred to as 'labels') of a type having a removable adhesive covering backing to sheet material for purposes of identification. This procedure, including manual removal of the backing is time consuming and frequently results in misplaced or wrinkled labels. The present invention has been evolved to avoid the objectionable characteristics of hand application. More specifically, the herein disclosed method and means involves apparatus to assist placement of the label on the sheet material and to then automatically cause the backing to be peeled from the adhesive label and cause the label to be adhesively secured to the sheet material.

It is therefore an object of the invention to provide novel apparatus for affixing adhesive bearing labels to a surface.

Another object is to provide a novel method for affixing adhesive bearing labels to a surface.

Another object is to provide a novel means to peel off a backing from an adhesively coated label and simultaneously affix said label to a flat surface.

Another object is to provide novel apparatus of the character referred to which includes reciprocable means operable to peel the backing off of an adhesive label and affix said label to a sheet of material.

Another object is to provide a novel method of removing a backing from an adhesively coated element and affixing said element to a sheet of material.

Another object is to provide novel method and means for affixing adhesive coated labels to a surface which is simple, very efficient and low in cost.

Other objects and advantages of the invention will become apparent with reference to the following description and accompanying drawings.

IN THE DRAWINGS

FIG. 1 is a top plan view of representative apparatus used to locate and affix adhesive coated labels to a sheet of material.

FIG. 2 is a perspective view of a representative label.

FIG. 3 is a sectional view taken substantially along line 3—3 of FIG. 1, showing a label about to be attached to a sheet and partially folded to facilitate removal of a part of its backing.

FIG. 4 is a view similar to FIG. 3, showing the backing partially peeled off and the label partially attached.

FIG. 5 is a similar view showing one-half of the label adhesively secured to the sheet.

FIG. 6 illustrates the initial position of the label at the start of the operation to secure the other half of the label to the sheet.

FIG. 7 is a view similar to FIG. 6, showing the said other half of the label partially secured.

FIG. 8 illustrates the label fully affixed to the sheet.

Referring to the disclosure in the accompanying drawings, and particularly to FIG. 1, the apparatus includes a table 11 or other flat surface having a plurality of spaced perforations 12, therein which are connected to a source of negative pressure through a line 13 so as to create suction for holding a flat sheet 14 against shifting on the table. The sheet 14 is positioned in a preselected location on the table by having two of its edges abutting adjustable stop means 15, 16. A label 17 to be attached to said sheet 14 is laid thereover in the desired position with its backing sheet **17*a*** intact.

The label 17, best shown in FIG. 2, may be of any requisite size and it includes a top sheet **17*b* having a pressure sensitive adhesive 17*c* on its bottom face normally covered by the removable backing 17*a*. The backing is split midway its length, as at 17*d***, to facilitate its removal in a manner and by means of the herein disclosed apparatus.

Arranged over the top of table 11 and reciprocably movable thereover and over label 17 therebeneath is a flat bar or straight edge 18 having its longitudinal edges bevelled as at 19. An adjustable stop 20 is carried by the bar to assist in locating the label 17 on sheet 14. This straight edge has one end connected firmly to member 21 slidably mounted on a guide 22 arranged along one edge of and beneath table 11. The member 21 has an extension 23 to which is pivotally connected one end of a link 24, as at 25, the other end of which is pivotally connected, as at 26, to an eccentric arm 27 carried on shaft 28 of a motor 29, all arranged beneath table 11. This arrangement is such that while the motor is operating, the straight edge 18 is reciprocably moved back and forth across the table top.

Now, in order to adhesively secure label 17 to sheet 14, the label is located beneath straight edge 18 in such position that when the straight edge is substantially midway its complete stroke, the split **17*d* in the backing is in substantial alignment with one edge 19. One-half of the label is folded up and over the straight edge, as shown in FIG. 3, whereupon the motor is actuated to carry the straight edge forwardly against the fold. As it advances, the edge of the related one-half of the backing 17*a* rides freely over the surface of sheet 14 and is peeled off the label, as best shown in FIGS. 4 and 5, to expose the adhesive and secure the said half of the label to sheet 14. When the direction of movement of the straight edge is reversed, the unsecured half of label 17 is folded upwardly as shown in FIG. 6 and the step of removing the other half of the backing is effected (FIG. 7**) to permit the said other half of the label to be secured to the sheet. The sheet, with the label attached, is then removed from the table and the operation is repeated for the next successive sheet and label.

Although continued operation is preferable and is intended, the motor 29 can be controlled for intermittent operation to afford the operator sufficient time to locate the sheet and label in position. Also, in the absence of the power drive, a hand hold 31 is provided on straight edge 18 for manual movement of said straight edge.

Although I have described a preferred embodiment of my invention, in considerable detail, it will be understood that the description thereof is intended to be illustrative rather than restrictive, as details of the structure may be modified or changed without departing from the spirit or scope of the invention. Accordingly, I do not desire to be restricted to the exact construction or steps of the method herein described.

I claim:

1. The method of adhesively securing to a sheet an adhesive coated label having a split backing covering the adhesive comprising laying said label on with its backing contacting said sheet, folding said label along said split to provide an upstanding portion, applying pressure against the side opposite the backing of said upstanding to cause the related backing portion to peel off said label and force said uncovered adhesive against said sheet, folding the other half of said label along said split to provide an upstanding portion, and applying pressure against the side opposite the backing of said upstanding portion to cause the related backing portion to peel off said label and force said uncovered adhesive against said sheet.

2. The method recited in claim 1, in which the pressure is initially applied to the upstanding portions at the fold and progressively applied along the length of each portion.

3. The method recited in claim 1, including the added step of utilizing negative pressure to hold the sheet in place.

4. The method of removing a split backing from an adhesive coated label while attaching said label to a surface comprising the steps of folding said label upwardly along the line of said split to provide an upstanding portion, locating a straight edge at the fold on the side opposite the backing and advancing it against the upstanding portion to cause the related backing portion to peel off and to press the adhesive coated label portion against the surface, folding the other unattached portion of the label upwardly along the line of the split, locating a straight edge at the fold on the side opposite the backing and advancing it in the other direction against said upstanding portion to cause the related backing portion to peel off and to press the last named adhesive coated label portion against said surface.

5. The method recited in claim 4, including the additional step of applying motor power to the straight edge to move it in both directions.

* * * * *